US007823705B2

(12) United States Patent
Ueda et al.

(10) Patent No.: US 7,823,705 B2
(45) Date of Patent: Nov. 2, 2010

(54) ELEVATOR APPARATUS CONTROL BY MEASURING CHANGES IN A PHYSICAL QUANTITY OTHER THAN TEMPERATURE

(75) Inventors: Takaharu Ueda, Tokyo (JP); Masaya Sakai, Tokyo (JP); Takashi Yumura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 614 days.

(21) Appl. No.: 11/721,251

(22) PCT Filed: Sep. 30, 2005

(86) PCT No.: PCT/JP2005/018161

§ 371 (c)(1),
(2), (4) Date: Jun. 8, 2007

(87) PCT Pub. No.: WO2007/039928

PCT Pub. Date: Apr. 12, 2007

(65) Prior Publication Data

US 2009/0236184 A1 Sep. 24, 2009

(51) Int. Cl.
*B66B 1/34* (2006.01)

(52) U.S. Cl. ..... 187/393; 187/281

(58) Field of Classification Search ..... 187/391–394, 187/277, 281, 282, 305; 318/434, 471, 472; 361/23, 24, 25, 27
See application file for complete search history.

(56) References Cited

U.S. PATENT DOCUMENTS 3,891,064 A * 6/1975 Clark ..... 187/295
3,961,688 A * 6/1976 Maynard ..... 187/289
3,973,648 A * 8/1976 Hummert et al. ..... 187/393
4,271,931 A * 6/1981 Watanabe ..... 187/292
4,427,095 A * 1/1984 Payne et al. ..... 187/394
4,512,442 A * 4/1985 Moore et al. ..... 187/393
4,527,662 A * 7/1985 Doane et al. ..... 187/293
4,534,452 A * 8/1985 Ogasawara et al. ..... 187/285

(Continued)

FOREIGN PATENT DOCUMENTS

JP 3029883 4/2000

(Continued)

*Primary Examiner*—Jonathan Salata
(74) *Attorney, Agent, or Firm*—Oblon, Spivak, McClelland, Maier & Neustadt, L.L.P.

(57) ABSTRACT

An elevator apparatus is equipped with an elevator component that is operated during operation of an elevator, a detector for measuring a change in a physical quantity other than temperature as to the elevator component, and a control device for controlling the operation of the elevator based on information from the detector. The elevator component is, for example, a hoisting machine for moving a car of the elevator. The hoisting machine has a motor, and a driving sheave that is rotated by the motor. The detector measures a strain of a frame of the motor as the physical quantity other than temperature. The control device determines based on the strain of the frame of the motor whether or not there is an abnormality in the operation of the elevator, and controls the operation of the elevator. It is therefore possible to determine easily and more reliably whether or not there is an abnormality in the operation of the elevator, without the need to directly measure the temperature of the motor (6).

6 Claims, 7 Drawing Sheets

U.S. PATENT DOCUMENTS

| | | | | |
|---|---|---|---|---|
| 4,671,389 | A * | 6/1987 | Tanahashi | 187/296 |
| 5,025,896 | A * | 6/1991 | Arabori et al. | 187/292 |
| 5,266,756 | A * | 11/1993 | Hatano | 187/285 |
| 6,305,503 | B1 * | 10/2001 | Suzuki et al. | 187/393 |
| 6,325,179 | B1 * | 12/2001 | Barreiro et al. | 187/393 |
| 6,450,299 | B1 * | 9/2002 | Lysaght | 187/393 |
| 6,543,583 | B1 * | 4/2003 | Lence Barreiro et al. | 187/391 |
| 2007/0012521 | A1 * | 1/2007 | Sakai et al. | 187/380 |

FOREIGN PATENT DOCUMENTS

| | | |
|---|---|---|
| JP | 2002 3091 | 1/2002 |
| JP | 2002 114455 | 4/2002 |
| KR | 2000-0009072 | 2/2000 |
| WO | 03 050028 | 6/2003 |

* cited by examiner

ELEVATOR APPARATUS CONTROL BY MEASURING CHANGES IN A PHYSICAL QUANTITY OTHER THAN TEMPERATURE

TECHNICAL FIELD

The present invention relates to an elevator apparatus having a car that is raised/lowered within a hoistway.

BACKGROUND ART

Conventionally, there is proposed an elevator designed such that a changeover to an operation for reducing the electric load of the elevator is made when the temperature of a motor for moving a car of the elevator exceeds a set threshold. The temperature of the motor is measured by a temperature detector. Thus, the temperature of the motor is prevented from exceeding an allowable limit temperature thereof even after having risen due to an overload operation, so the operation of the elevator can be prevented from being stopped. Accordingly, the service of running the elevator can be improved (see Patent Document 1).

Patent Document 1: JP 2002-3091 A

DISCLOSURE OF THE INVENTION

Problem to be Solved by the Invention

In the conventional elevator, however, the temperature of the motor is measured by the temperature detector, so the overload operation of the elevator cannot be detected when there is a malfunction in the temperature detector. As a result, a changeover in operation mode may become impossible.

The present invention has been made to solve the above-mentioned problem, and it is therefore an object of the present invention to obtain an elevator apparatus capable of detecting easily and more reliably whether or not there is an abnormality in the operation of an elevator.

Means for Solving the Problem

An elevator apparatus according to the present invention includes: an elevator component that is operated during operation of an elevator; a detector for measuring a change in a physical quantity other than temperature as to the elevator component; and a control device for controlling the operation of the elevator based on information from the detector.

BEST MODES FOR CARRYING OUT THE INVENTION

Preferred embodiments of the present invention will be described hereinafter with reference to the drawings.

Embodiment 1

Figure 1:
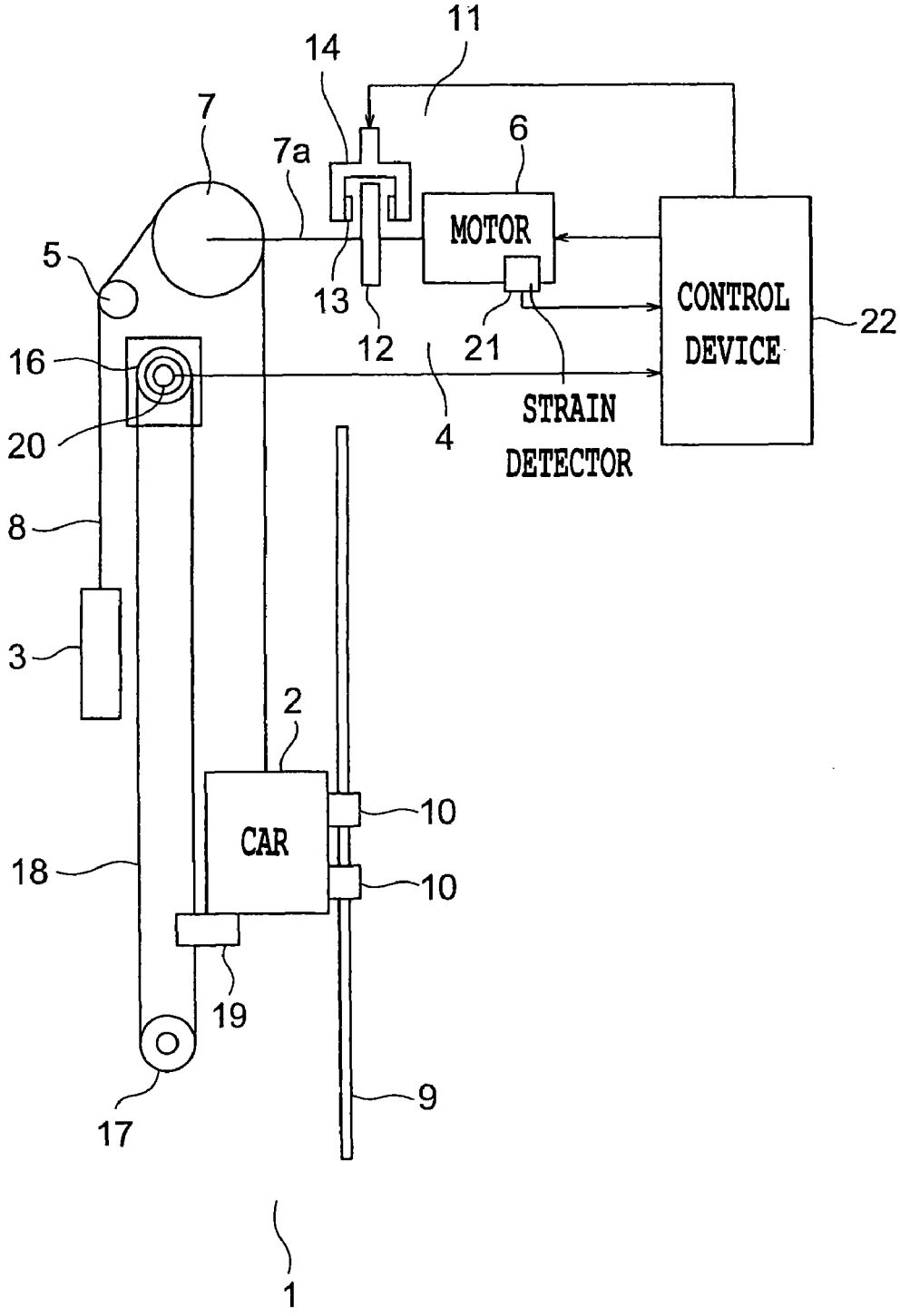
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 2 and a counterweight 3 are provided within a hoistway 1 in a manner allowing the car 2 and the counterweight 3 to be raised/lowered. A hoisting machine (driving device) 4 for raising/lowering the car 2 and the counterweight 3 and a deflector pulley (driven sheave) 5 provided in the vicinity of the hoisting machine 4 are provided in an upper portion of the hoistway 1. The hoisting machine 4 has a motor 6 and a driving sheave 7 that is rotated by the motor 6. A plurality of main ropes 8 are looped around the driving sheave 7 and the deflector pulley 5. The car 2 and the counterweight 3 are raised/lowered within the hoistway 1 through rotation of the driving sheave 7. The deflector pulley 5 is rotated through the raising/lowering of the car 2 and the counterweight 3.

A car guide rail 9 for guiding the movement of the car 2 and a counterweight guide rail (not shown) for guiding the movement of the counterweight 3 are installed within the hoistway 1. The car 2 is provided with a plurality of car guide shoes 10 that are guided while being engaged with the car guide rail 9. The counterweight 3 is provided with a counterweight guide shoe (not shown) that is guided while being engaged with the counterweight guide rail.

The hoisting machine 4 is mounted with a brake device 11 for braking rotation of the driving sheave 7. The brake device 11 has a brake disc (rotation body) 12 that is rotated integrally with the driving sheave 7, a brake shoe (braking body) 13 movable into contact with and away from the brake disc 12, and a braking body displacement device 14 for displacing the brake shoe 13 in such a direction that the brake shoe 13 moves into contact with and away from the brake disc 12. The brake disc 12 is provided on a rotating shaft 7*a* of the driving sheave 7. The braking body displacement device 14 has a spring (urging body) for urging the brake shoe 13 in such a direction that the brake shoe 13 moves into contact with the brake disc 12, and an electromagnet for displacing the brake shoe 13 through energization, against an urging force of the spring, in such a direction that the brake shoe 13 moves away from the brake disc 12.

A braking force for braking rotation of the driving sheave 7 is applied thereto through contact of the brake shoe 13 with the brake disc 12. The braking force applied to the driving sheave 7 is canceled through the opening of the brake shoe 13 away from the brake disc 12. The braking force applied to the driving sheave 7 is canceled when the car 2 is moved. The braking force is applied to the driving sheave 7 when the car 2 is stopped at a destination floor.

An upper pulley 16 is provided in the upper portion of the hoistway 1. A tension pulley (lower pulley) 17 is provided in a lower portion of the hoistway 1. A speed detection rope 18 is looped between the upper pulley 16 and the tension pulley 17. The speed detection rope 18 is connected at one end thereof and the other end thereof to a car mount member 19 mounted on the car 2. Thus, the speed detection rope 18 is moved together with the car 2. The upper pulley 16 is rotated at a speed corresponding to the movement of the speed detection rope 18. That is, the upper pulley 16 is rotated as the car 2 is moved.

The upper pulley 16 is provided with an encoder 20 for generating a signal corresponding to the rotation of the upper pulley 16. A frame of the motor 6 is provided with a strain detector 21 for measuring a change in strain (physical quantity other than temperature) of the frame.

Figure 2:
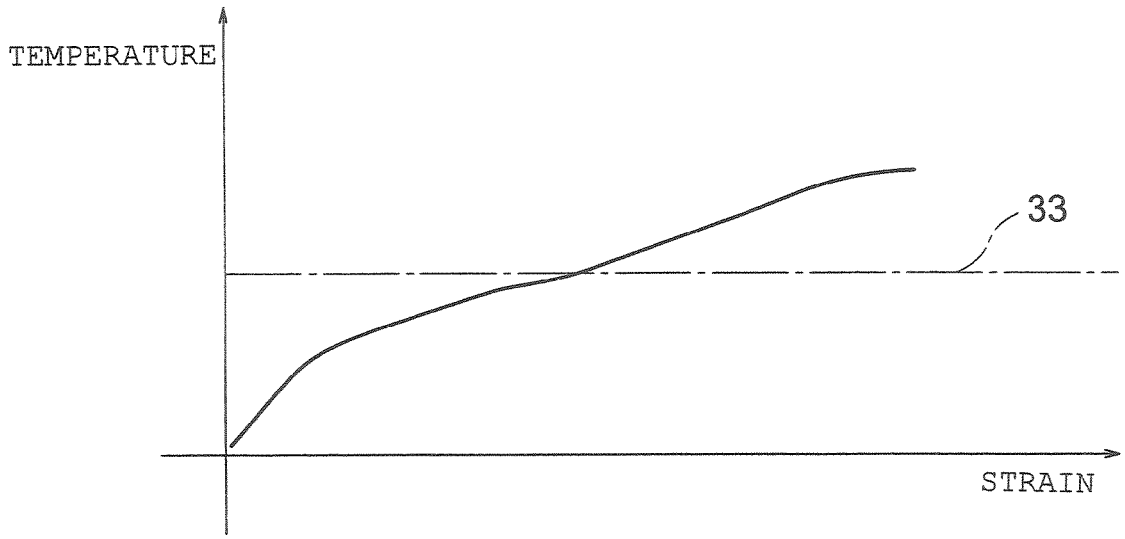
FIG. 2 is a graph showing a relationship between the strain of the frame of the motor of FIG. 1 and the temperature of the motor.

FIG. 2 is a graph showing a relationship between the strain of the frame of the motor 6 of FIG. 1 and the temperature of the motor 6. As shown in FIG. 2, the strain of the frame of the motor 6 changes in accordance with the temperature of the motor 6. That is, the temperature of the motor 6 rises as the strain of the frame of the motor 6 increases. Accordingly, it is possible to determine based on a change in the strain of the frame whether or not there is an abnormality in the operation of the elevator.

Information from the encoder 20 and information from the strain detector 21 are transmitted to a control device 22 for controlling the operation of the elevator. The control device 22 controls the operation of the elevator based on the information from the encoder 20 and the information from the strain detector 21.

That is, the control device 22 determines based on the information from the strain detector 21 whether or not there is an abnormality in the operation of the elevator. That is, the control device 22 compares a strain measured by the strain detector 21 with a preset criterion value to determine whether or not there is an abnormality in the operation of the elevator. The criterion value set in the control device 22 is defined as a strain of the frame corresponding to a temperature (criterion temperature level) 33 (FIG. 2) of the motor 6 during a shift of the operation of the elevator from a normal state to an abnormal state.

The control device 22 can be changed over between a rated operation mode and a high speed operation mode, based on the determination made on whether or not there is an abnormality in the operation of the elevator. In the rated operation mode, the speed of the car 2 is controlled according to a rated speed pattern. In the high speed operation mode, the speed of the car 2 is controlled according to a high speed pattern in which a time from the start of the movement of the car 2 to normal stoppage thereof is shorter than in the rated operation mode. That is, the control device 22 can be changed over between the rated operation mode and the high speed operation mode, which are different from each other in the electric load of the motor 6, based on the determination made on whether or not there is an abnormality in the operation of the elevator The operation mode of the control device 22 is set to the high speed operation mode when the value of the strain measured by the strain detector 21 is equal to or smaller than the criterion value (in the case of a normal load), and set to the rated operation mode when the value of the strain is larger than the criterion value (in the case of an overload). In the rated operation mode, the electric load of the motor 6 is smaller than in the high speed operation mode.

Figure 3:
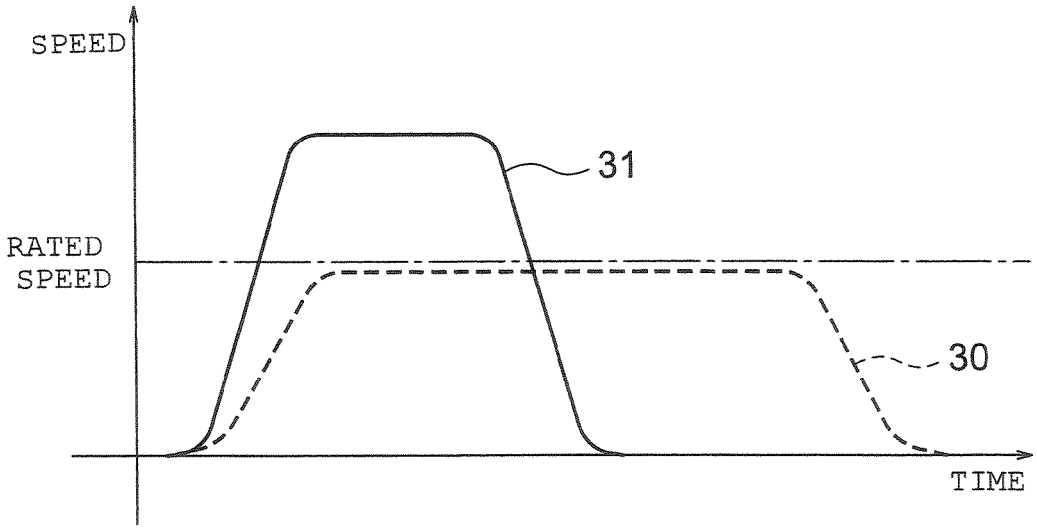
FIG. 3 is a graph showing the speed patterns set in the control device of FIG. 1, namely, the rated speed pattern (changes in the speed of the car with time in the rated operation mode) and the high speed pattern (changes in the speed of the car with time in the high speed operation mode).

FIG. 3 is a graph showing the speed patterns set in the control device 22 of FIG. 1, namely, the rated speed pattern (changes in the speed of the car 2 with time in the rated operation mode) and the high speed pattern (changes in the speed of the car 2 with time in the high speed operation mode). Referring to FIG. 3, the maximum speed in a rated speed pattern 30 is a preset rated speed. The maximum speed, acceleration, and jerk in a high speed pattern 31 are set higher than the maximum speed, acceleration, and jerk in the rated speed pattern 30, respectively. In the rated speed pattern 30 and the high speed pattern 31 shown in FIG. 3, the same distance is covered by the car 2 during the time from the start of the movement thereof to the normal stoppage thereof. Accordingly, a region surrounded by the rated speed pattern 30 and a time axis is equal in area to a region surrounded by the high speed pattern 31 and the time axis.

The control device 22 is constituted by a computer having a calculation processing portion (CPU), a storage portion (ROM, RAM, and the like), and signal input/output portions. Data such as the rated speed pattern, the high speed pattern, and the criterion value, control programs for realizing a changeover in mode and a determination on whether or not there is an abnormality in the operation of the elevator, and the like are stored in the storage portion. Based on the control programs, the calculation processing portion performs calculation processings regarding the control of the operation of the elevator.

Figure 4:
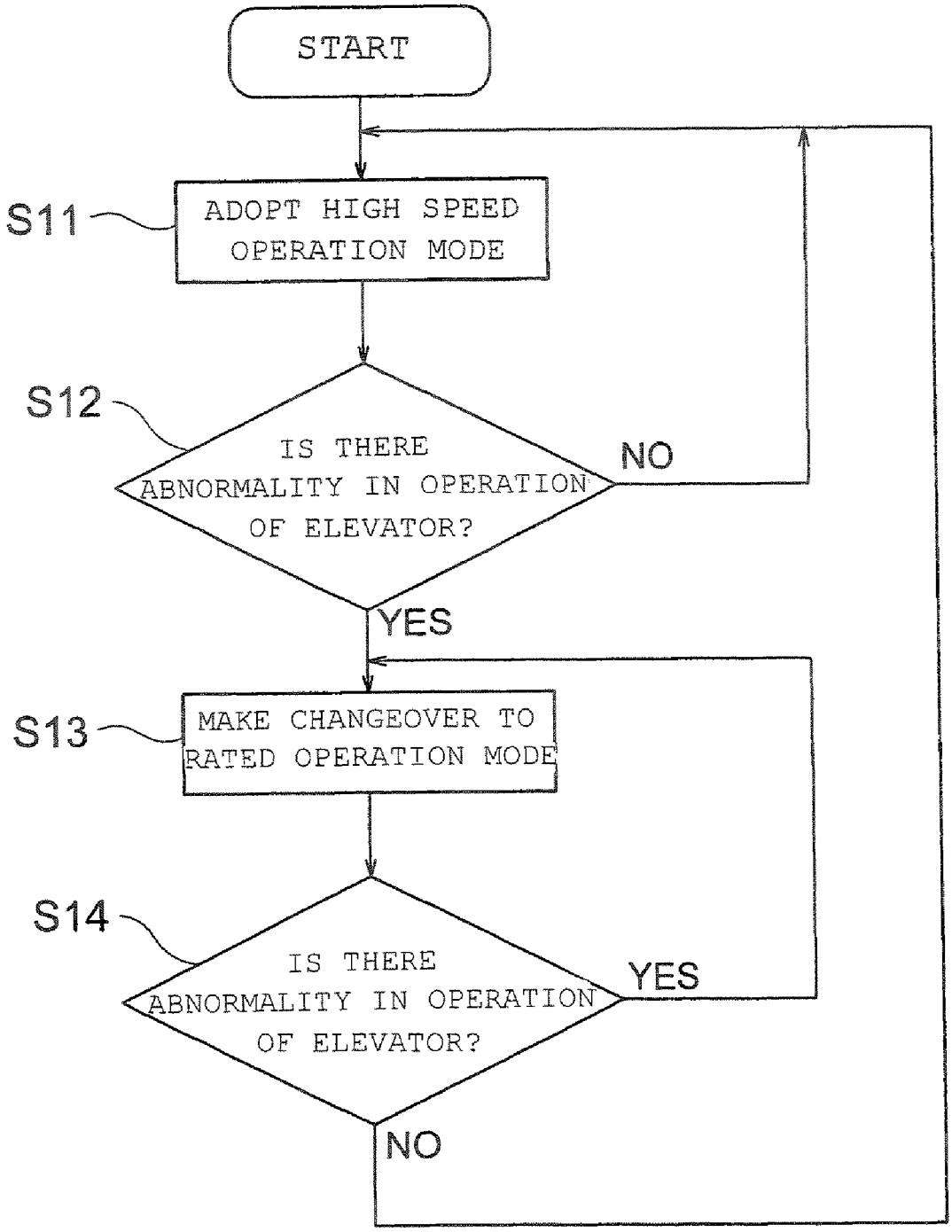
FIG. 4 is a flowchart showing a processing operation of the control device of FIG. 1.

Next, an operation will be described. FIG. 4 is a flowchart showing a processing operation of the control device 22 of FIG. 1. As shown in FIG. 4, the operation mode in the control device 22 is normally set to the high speed operation mode (S11). In this state, the speed of the car 2 is controlled according to the high speed pattern 31 (FIG. 3).

It is constantly determined in the control device 22, based on information from the strain detector 21, whether or not there is an abnormality in the operation of the elevator (S12). When there is no abnormality in the operation of the elevator, the high speed operation mode continues.

When it is determined that there is an abnormality in the operation of the elevator, the operation mode in the control device 22 is changed over from the high speed operation mode to the rated operation mode (S13). In the rated operation mode, the speed of the car 2 is controlled according to the rated speed pattern 30.

After that as well, the control device 22 determines whether or not there is an abnormality in the operation of the elevator (S14). In a case where the abnormality in the operation of the elevator has not been eliminated, the operation in the rated operation mode continues. On the other hand, in a case where the abnormality in the operation of the elevator has been eliminated, the operation mode in the control device 22 is changed over again from the rated operation mode to the high speed operation mode.

In the elevator apparatus constructed as described above, the strain of the hoisting machine 4 is measured by the strain detector 21, and the operation of the elevator is controlled based on the information from the strain detector 21. It is therefore possible to determine easily and more reliably with a simple construction whether or not there is an abnormality in the operation of the elevator, without the need to measure the temperature of any elevator component. The strain of the hoisting machine 4 changes in accordance with the load of the operation of the elevator, so it is possible to perform control in accordance with the load of the operation of the elevator. As a result, it is possible to change the operation of the elevator before the operation of the elevator is stopped due to a malfunction in the elevator component. Accordingly, it is possible to continue the operation of the elevator and hence prevent a substantial deterioration in the running service thereof even in a case where the operation of the elevator has become overloaded.

In the foregoing example, the strain of the frame of the motor 6 is measured by the strain detector 21. However, the strain of any elevator component may be measured as long as this elevator component is operated as the car 2 is moved. For example, the strain of a body of the motor 6, the deflector pulley 5, the driving sheave 7, the guide shoe 10, or the brake device 11 may be measured by the strain detector 21 as the strain of the elevator component. In this manner as well, for the reason that a strain is developed in the body of the motor 6, the deflector pulley 5, the guide shoe 10, or the brake device 11 during the operation of the elevator, it is possible to determine easily whether or not there is an abnormality in the operation of the elevator.

In the foregoing example, the rated speed pattern and the high speed pattern are set in the control device 22 in advance. However, it is also appropriate to calculate a maximum speed, an acceleration, and a jerk which are corresponding to the calculated strain, and set the rated speed pattern and the high speed pattern based on the calculated maximum speed, the calculated acceleration, and the calculated jerk.

In the foregoing example, the control device 22 can be changed over between two operation modes, namely, the rated operation mode and the high speed operation mode. However, the control device 22 may be changed over to an intermediate operation mode as well as the rated operation mode and the high speed operation mode. In the intermediate operation mode, the moving time of the car 2 is longer than in the high speed operation mode and shorter than in the rated operation mode. In this case, the criterion value for a changeover in mode increases in the order of the rated operation mode, the intermediate operation mode, and the high speed operation mode. Thus, the time it takes before the car 2 reaches a destination floor changes gradually in accordance with the value of strain instead of changing drastically, so it is possible to prevent an extreme deterioration in running service.

In the foregoing example, the strain of the frame of the motor 6 is measured as the physical quantity thereof. However, it is also appropriate to cause a faint current to flow through the frame of the motor 6 and measure an electric resistance value (physical quantity other than temperature) of the frame itself. In this manner as well, for the reason that the electric resistance value of the frame changes in accordance with the temperature thereof, it is possible to determine easily whether or not there is an abnormality in the operation of the elevator.

Embodiment 2

Figure 5:
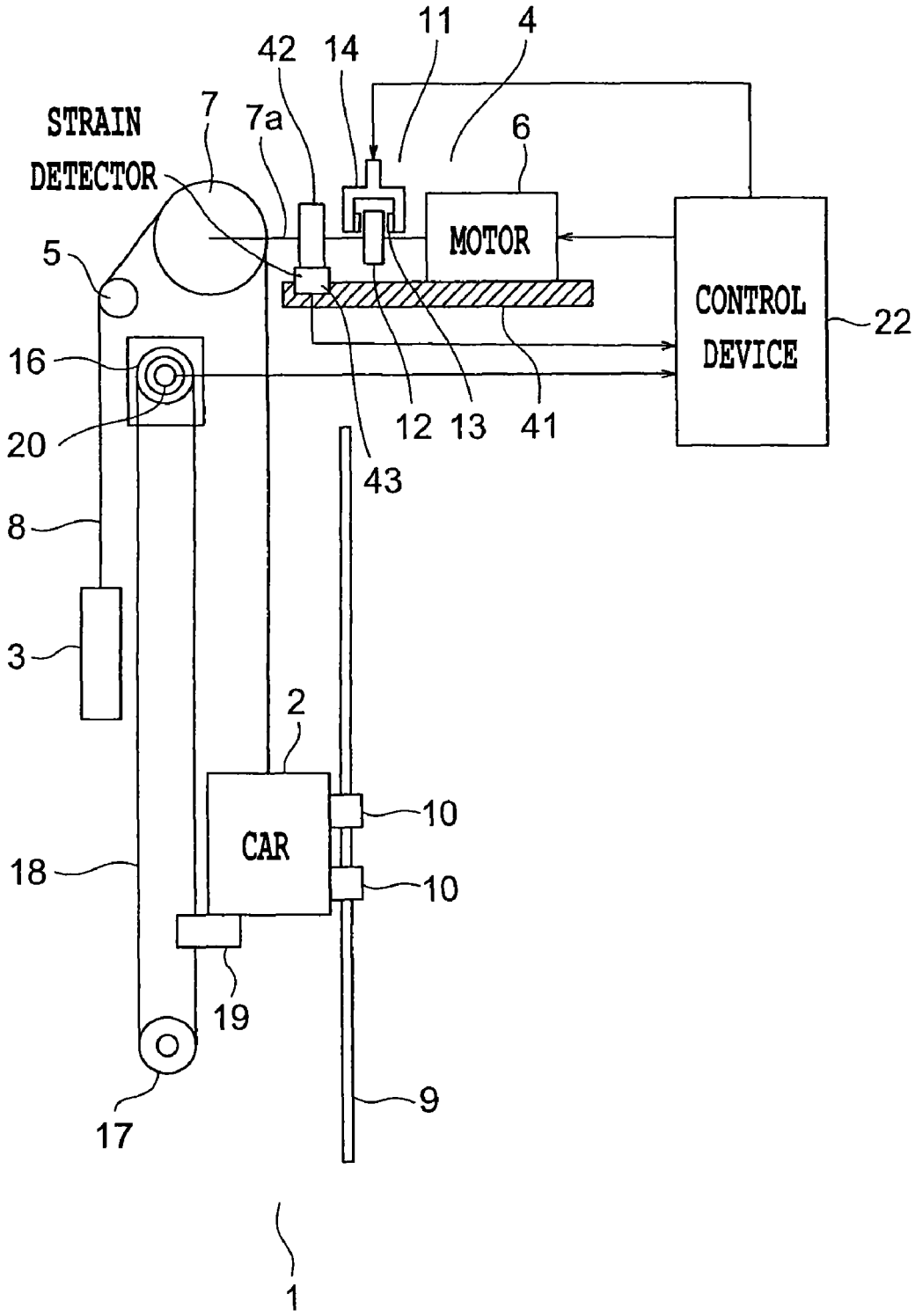
FIG. 5 is a schematic diagram showing an elevator apparatus according to Embodiment 2 of the present invention.

FIG. 5 is a schematic diagram showing an elevator apparatus according to Embodiment 2 of the present invention. Referring to FIG. 5, the hoisting machine 4 is supported by a support pedestal 41 fixed in the upper portion of the hoistway 1. The support pedestal 41 is provided with a hoisting machine bearing 42 for rotatably pivoting the rotating shaft 7*a* of the driving sheave 7. An oil for lubrication and refrigeration has been injected into the hoisting machine bearing 42. The hoisting machine bearing 42 is provided with a strain detector 43 for measuring a strain thereof. Information from the strain detector 43 is transmitted to the control device 22. The control device 22 controls the operation of the elevator based on the information from the strain detector 43. Embodiment 2 of the present invention is identical to Embodiment 1 of the present invention in other constructional details and other operational details.

As described above, the operation of the elevator is controlled based on the strain of the hoisting machine bearing 42, so it is possible to determine easily with a simple construction whether or not there is an abnormality in the operation of the elevator, without the need to measure the temperature of the motor 6.

In the foregoing example, the strain of the hoisting machine bearing 42 for pivoting the rotating shaft 7*a* of the driving sheave 7 is measured. However, it is also appropriate to measure a strain of a bearing for pivoting the deflector pulley 5, a bearing for pivoting the upper pulley 16, or a bearing for pivoting the tension pulley 17. In this manner as well, it is possible to determine easily whether or not there is an abnormality in the operation of the elevator.

In the foregoing example, the strain of the hoisting machine bearing 42 is measured to determine whether or not there is an abnormality in the operation of the elevator. However, it is also appropriate to measure a pressure or a viscosity (physical quantity other than temperature) of the oil injected into the hoisting machine bearing 42 by means of a pressure detector. Alternatively, it is also appropriate to measure a pressure or a viscosity of an oil injected into each of the bearings for pivoting the deflector pulley 5, the upper pulley 16, and the tension pulley 17. In this manner as well, for the reason that the pressure and viscosity of the oil change in accordance with the operation of the elevator, it is possible to determine easily whether or not there is an abnormality in the operation of the elevator.

Embodiment 3

Figure 6:
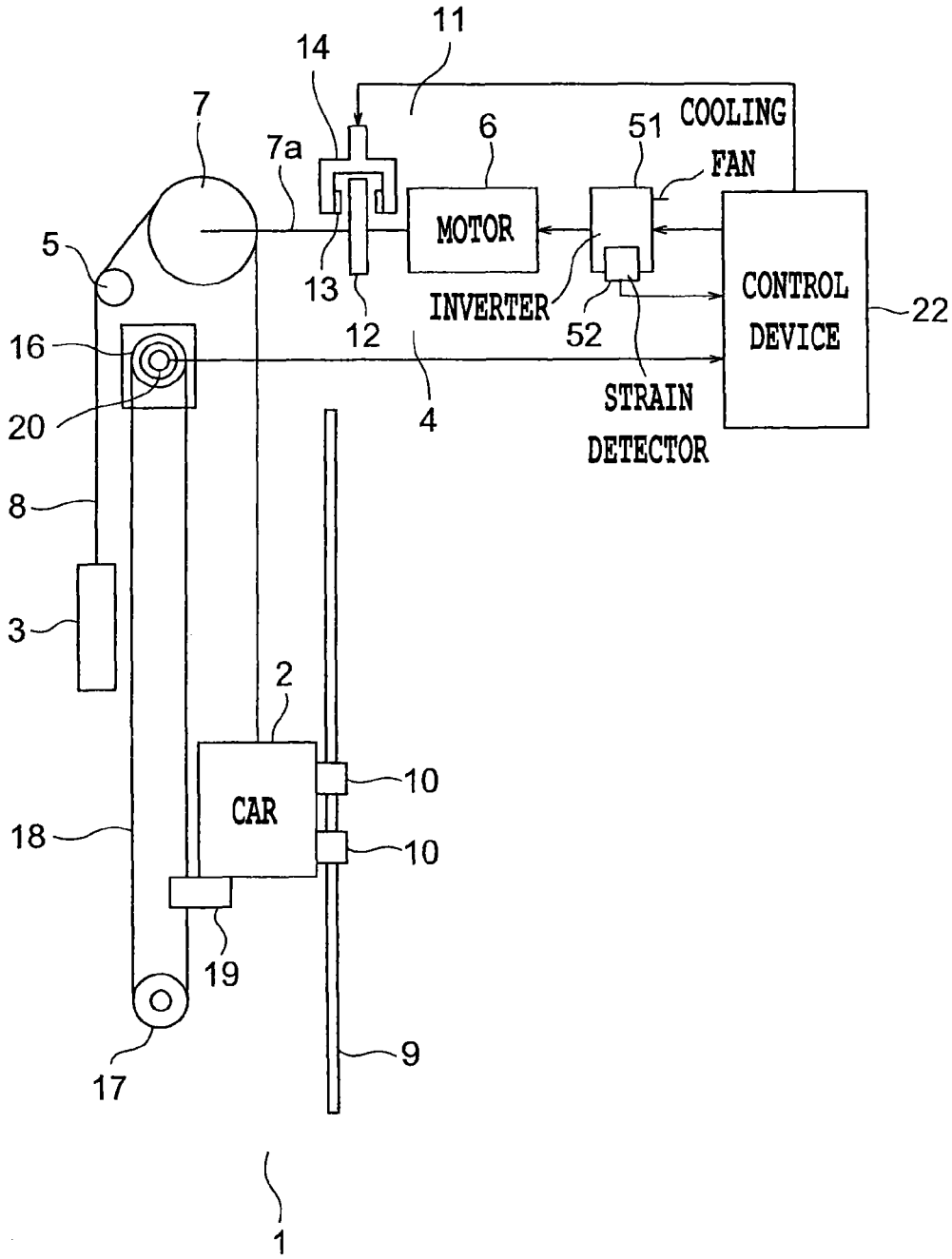
FIG. 6 is a schematic diagram showing an elevator apparatus according to Embodiment 3 of the present invention.

FIG. 6 is a schematic diagram showing an elevator apparatus according to Embodiment 3 of the present invention. Referring to FIG. 6, the motor 6 is controlled by the control device 22 via an inverter 51 capable of continuously increasing/reducing the rotational speed of the driving sheave 7. The inverter 51 is provided with a cooling fin. The inverter 51 is also provided with a strain detector 52 for measuring a strain of the fin 51A. Information from the strain detector 52 is transmitted to the control device 22. The control device 22 controls the operation of the elevator based on the information from the strain detector 52. Embodiment 3 of the present invention is identical to Embodiment 1 of the present invention in other constructional details and other operational details.

As described above, the operation of the elevator is controlled based on the strain of the fin provided on the inverter 51 for controlling the rotational speed of the driving sheave 7. It is therefore possible to determine easily with a simple construction whether or not there is an abnormality in the operation of the elevator, without the need to measure the temperature of the motor 6.

In the foregoing example, the strain of the fin of the inverter 51 is measured to determine whether or not there is an abnormality in the operation of the elevator. However, it is also appropriate to calculate a regenerative resistance based on a power generated by the motor 6 during regenerative operation, and determine based on the calculated regenerative resistance whether or not there is an abnormality in the operation of the elevator.

Embodiment 4

Figure 7:
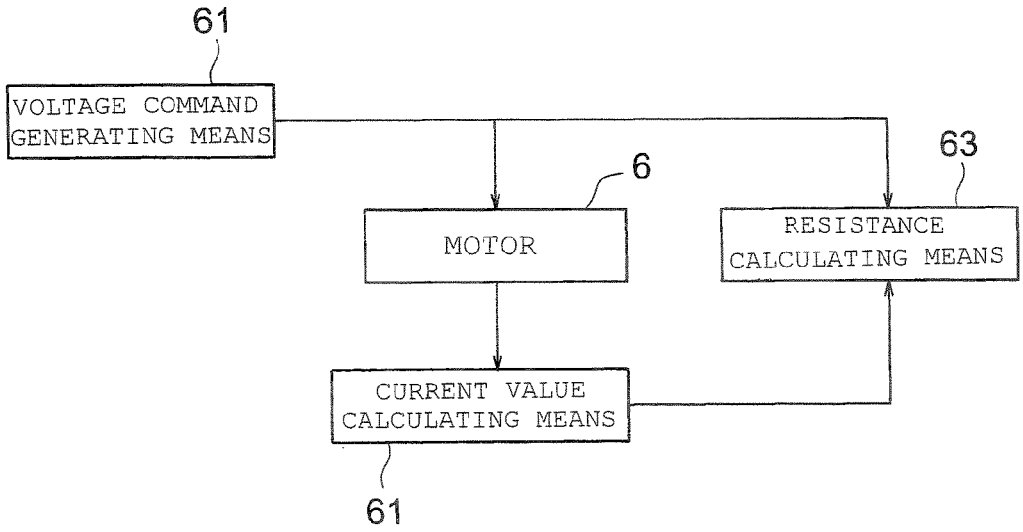
FIG. 7 is a functional block diagram showing the configuration for calculating a resistance value of a coil of the motor in an elevator apparatus according to Embodiment 4 of the present invention.

FIG. 7 is a functional block diagram showing the configuration for calculating a resistance value of a coil of the motor 6 in an elevator apparatus according to Embodiment 4 of the present invention. Referring to FIG. 7, the control device 22 has voltage command generating means 61 for generating a voltage command for the motor 6, current value calculating means 62 for calculating a value of a current flowing through the coil of the motor 6 based on information from a current detector (not shown) for detecting the value of the current flowing through the coil of the motor 6, and resistance calculating means 63 for calculating an electric resistance value of the coil of the motor 6 based on the voltage generated by the voltage command generating means 61 and the value of the current calculated by the current value calculating means 62.

Figure 8:
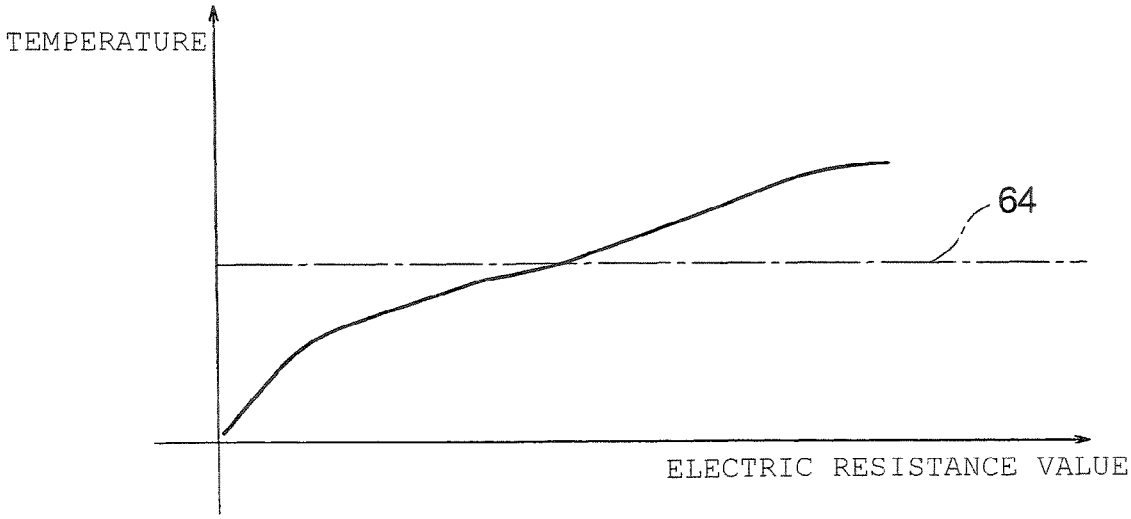
FIG. 8 is a graph showing a relationship between the electric resistance value calculated by the resistance calculating means of FIG. 7 and the temperature of the motor.

FIG. 8 is a graph showing a relationship between the electric resistance value calculated by the resistance calculating means 63 of FIG. 7 and the temperature of the motor 6. As shown in FIG. 8, the electric resistance value of the coil of the motor 6 changes in accordance with the temperature of the motor 6. That is, the electric resistance value of the coil of the motor 6 increases as the temperature of the motor 6 rises. Accordingly, it is possible to determine based on the electric resistance value of the coil of the motor 6 whether or not there is an abnormality in the operation of the elevator.

Thus, the control device 22 compares the electric resistance value calculated by the resistance calculating means 63 with a preset criterion value to determine whether or not there is an abnormality in the operation of the elevator. In this case, the criterion value is defined as an electric resistance value corresponding to a temperature (criterion temperature level) 64 (FIG. 8) of the motor 6 during a shift of the operation of the elevator from a normal state to an abnormal state. Embodiment 4 of the present invention is identical to Embodiment 1 of the present invention in other configurational details. The control device 22 operates in the same manner as in Embodiment 1 of the present invention except in determining whether or not there is an abnormality in the operation of the elevator.

Next, an operation performed in determining whether or not there is an abnormality in the operation of the elevator will be described. The voltage command from the voltage command generating means 61 and the current value calculated by the current value calculating means 62 are constantly input to the resistance calculating means 63. In the resistance calculating means 63, the input voltage command is divided by the current value to calculate an electric resistance value. After that, the electric resistance value calculated by the resistance calculating means 63 is compared with the criterion value set in the control device 22. As a result, when the electric resistance value is larger than the criterion value, it is determined that there has been an abnormality in the operation of the elevator. When the electric resistance value is equal to or smaller than the criterion value, it is determined that the elevator is in normal operation. The subsequent operation is the same as in Embodiment 1 of the present invention.

As described above, the operation of the elevator is controlled based on the electric resistance value of the coil of the motor 6. It is therefore possible to determine easily with a simple configuration whether or not there is an abnormality in the operation of the elevator, without the need to measure the temperature of the motor 6.

In the foregoing example, it is determined based on the electric resistance value of the coil of the motor 6 whether or not there is an abnormality in the operation of the elevator. However, it is also appropriate to determine, based on an electric resistance value of a brake coil of the electromagnet mounted on the braking body displacement device 14, whether or not there is an abnormality in the operation of the elevator.

Embodiment 5

Figure 9:
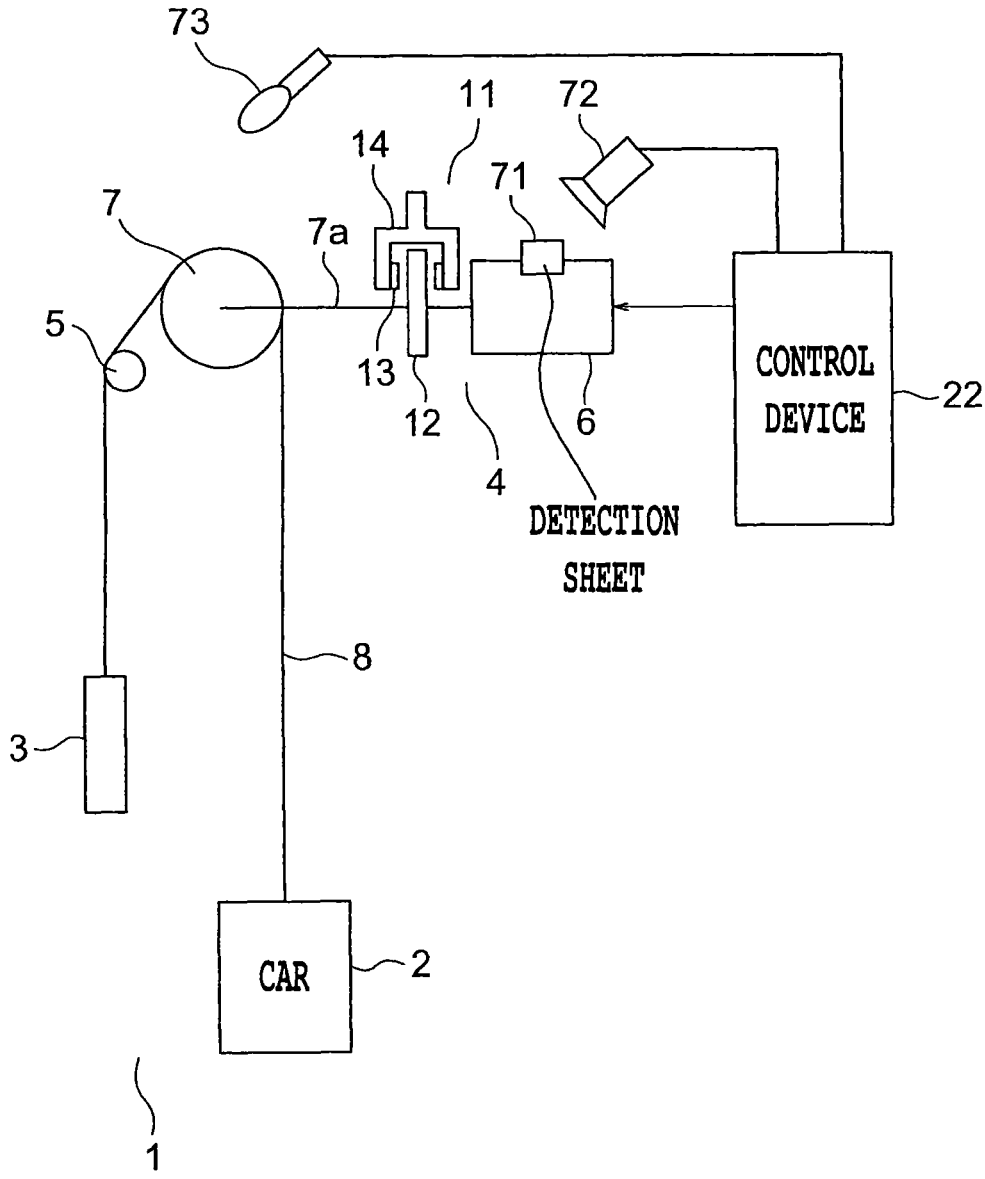
FIG. 9 is a schematic diagram showing an elevator apparatus according to Embodiment 5 of the present invention.

FIG. 9 is a schematic diagram showing an elevator apparatus according to Embodiment 5 of the present invention. Referring to FIG. 9, the motor 6 is provided with a detection sheet 71 that changes in color (physical quantity other than temperature) in accordance with a change in the temperature thereof. A camera (imaging means) 72 for imaging the detection sheet 71 is provided in the vicinity of the hoisting machine 4. A microphone (sound collecting means) 73 for generating a signal corresponding to a sound (physical quantity other than temperature) within the hoistway 1, such as a sound generated through vibrations of the motor 6, is provided within the hoistway 1. In this example, the microphone 73 is disposed in the vicinity of the hoisting machine 4.

Information from the camera 72 and information from the microphone 73 are input to the control device 22. The control device 22 calculates a rise in the temperature of the motor 6 corresponding to a change in the color of the detection sheet 71 based on the information from the camera 72, and compares the calculated rise in the temperature with a preset criterion value to determine whether or not there is an abnormality in the operation of the elevator. The control device 22 also calculates a noise level within the hoistway 1 based on the information from the microphone 73, and compares the calculated noise level with a preset criterion value to determine whether or not there is an abnormality in the operation of the elevator Embodiment 5 of the present invention is identical to Embodiment 1 of the present invention in other constructional details. The control device 22 operates in the same manner as in Embodiment 1 of the present invention, except in determining whether or not there is an abnormality in the operation of the elevator.

Next, an operation performed in determining whether or not there is an abnormality in the operation of the elevator will be described. Information from the camera 72 and information from the microphone 73 are constantly input to the control device 22. In the control device 22, it is determined based on the information from the camera 72 and the information from the microphone 73 whether or not there is an abnormality in the operation of the elevator. The subsequent operation is the same as in Embodiment 1 of the present invention.

As described above, the operation of the elevator is controlled based on at least one of the change in the color of the detection sheet 71 provided on the motor 6 and the noise level within the hoistway 1. It is therefore possible to determine easily with a simple construction whether or not there is an abnormality in the operation of the elevator, without the need to measure the temperature of the motor 6.

In the foregoing example, it is determined based on the change in the color of the detection sheet 71 or the noise level within the hoistway 1 whether or not there is an abnormality in the elevator. However, the intensity of infrared rays radiated from the motor 6 also changes in accordance with the temperature thereof, so it is also appropriate to determine based on the intensity of the infrared rays radiated from the motor 6 whether or not there is an abnormality in the elevator.

In the foregoing example, it is determined on a certain calculation cycle whether or not there is an abnormality in the operation of the elevator. However, it is also appropriate to calculate averages within a predetermined time including a plurality of calculation cycles as to the change in the color of the detection sheet 71, the noise level within the hoistway 1, and the intensity of the infrared rays radiated from the motor 6, respectively, and determine based on the calculated averages whether or not there is an abnormality in the operation of the elevator. In this manner, it is possible to average a temporarily generated noise (e.g., the voice of a passenger within the car 2 and the like) and hence prevent an erroneous determination from being made on whether or not there is an abnormality in the operation of the elevator.

The invention claimed is:

1. An elevator apparatus comprising:

an elevator component that is operated during operation of an elevator;

a detector for measuring a change in a physical quantity related to the load on the elevator component, other than a temperature of the elevator component; and a control device for controlling the operation of the elevator based on information from the detector, wherein the elevator component is a hoisting machine for moving a car of the elevator; and the physical quantity other than temperature is at least a level of a noise from the hoisting machine.

2. An elevator apparatus comprising:

an elevator component that is operated during operation of an elevator;

a detector for measuring a change in a physical quantity related to the load on the elevator component, other than a temperature of the elevator component; and a control device for controlling the operation of the elevator based on information from the detector, wherein:

the elevator component is a hoisting machine for moving a car of the elevator;

the hoisting machine has a motor, and a driving sheave that is rotated by the motor; and the physical quantity other than temperature is at least an electric resistance value of a coil of the motor, a regenerative resistance during regenerative operation, or a pressure/viscosity of an oil injected into a bearing for rotatably supporting a rotating shaft of the driving sheave.

3. An elevator apparatus, comprising:

an elevator component that is operated during operation of an elevator;

a detector for measuring a change in a physical quantity other than a temperature as to the elevator component; and a control device for controlling the operation of the elevator based on information from the detector, wherein:

the elevator component is a brake device for braking rotation of a driving sheave of a hoisting machine;

the brake device has a brake coil for cancelling a braking force applied to the driving sheave through energization; and the physical quantity other than temperature is an electric resistance value of the brake coil.

4. An elevator apparatus according to claim 1, wherein the control device calculates an average within a predetermined time as to at least the noise level and controls the operation of the elevator based on the calculated average.

5. An elevator apparatus according to any one of claims 1 2 or 3, wherein the control device calculates a maximum speed, an acceleration, and a jerk which are corresponding to changes in the physical quantities other than temperature, generates a speed pattern based on the calculated maximum speed, the calculated acceleration, and the calculated jerk, and controls a speed of a car of the elevator in accordance with the generated speed pattern.

6. An elevator apparatus comprising:

a motor that is operated during operation of an elevator;

a detector for measuring a change in color of an element whose color changes a function of the temperature of the motor; and a control device for controlling the operation of the elevator based on information from the detector.

* * * * *